US005198046A

United States Patent [19]

Bucerius et al.

[11] Patent Number: 5,198,046

[45] Date of Patent: Mar. 30, 1993

[54] STABLE, NITROGEN-RICH COMPOSITION

[75] Inventors: Klaus M. Bucerius, Karlsruhe; Friedrich-Wilhelm Wasmann, Pfinztal; Klaus Menke, Bruchsal, all of Fed. Rep. of Germany

[73] Assignee: Fraunhofer-Gesellschaft Zur Forderung Der Angewandten Forschund e.V., Munich, Fed. Rep. of Germany

[21] Appl. No.: 848,929

[22] Filed: Mar. 10, 1992

[30] Foreign Application Priority Data

Mar. 14, 1991 [DE] Fed. Rep. of Germany ..... 4108225

[51] Int. Cl.[5] ..... C06B 31/02

[52] U.S. Cl. ..... 149/61; 149/36; 149/109.4; 534/765

[58] Field of Search ..... 534/765; 149/61, 36, 149/109.4

[56] References Cited

U.S. PATENT DOCUMENTS

| | | | |
|---|---|---|---|
| 1,580,522 | 4/1926 | Rathsburg | 534/765 |
| 3,719,604 | 3/1973 | Prior | 534/765 |
| 3,909,322 | 9/1975 | Chang | 149/36 |
| 3,912,561 | 10/1975 | Doin et al. | 149/35 |
| 4,078,954 | 3/1978 | Bernardy | 149/19.8 |
| 4,340,755 | 7/1982 | Lawrence | 149/75 |
| 4,462,910 | 7/1984 | Lepaiz et al. | 210/610 |
| 4,601,344 | 7/1986 | Reed et al. | 149/19.6 |

*Primary Examiner*—Edward A. Miller

*Attorney, Agent, or Firm*—Antonelli, Terry, Stout & Kraus

[57] ABSTRACT

A stable, nitrogen-rich organic compound in the form of diguanidinium-5,5'-azotetrazolate having the empirical formula $C_4H_{12}N_{16}$, is with a pulverulent, chemically stable oxidizer as a pyrotechnic mixture for spontaneously generating environmentally friendly, non-toxic gases.

14 Claims, 1 Drawing Sheet

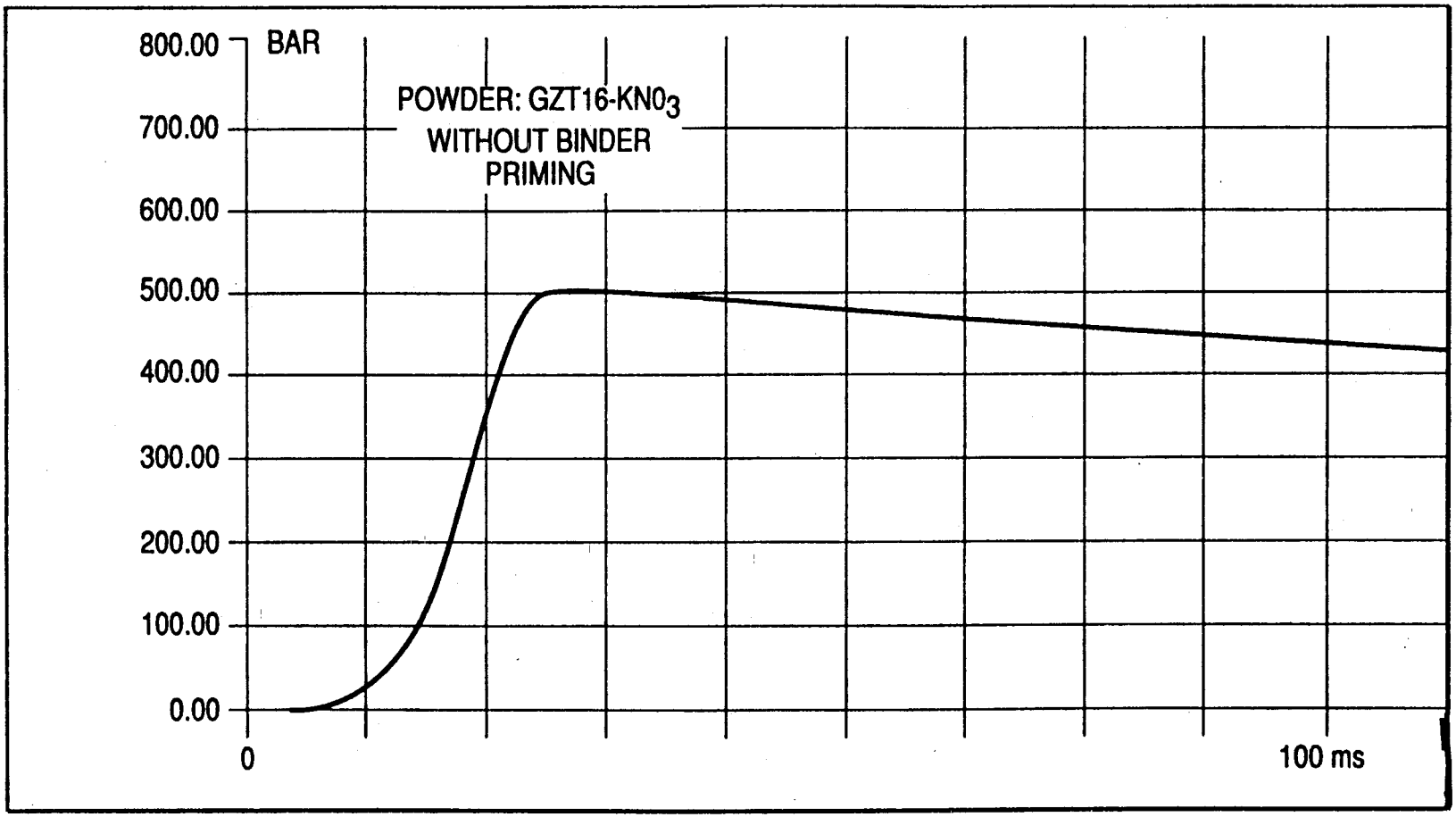
PRESSURE-TIME DIAGRAM OF A GZT-$KNO_3$ FORMULATION WITHOUT BINDER FOR A LOADING DENSITY OF 10g FOR A 100 $cm^3$ BOMB VOLUME

STABLE, NITROGEN-RICH COMPOSITION

The invention relates to a stable, nitrogen-rich, organic compound and its use as a pyrotechnic mixture.

Nitrogen-rich, organic compounds have many uses in chemistry and technology, both as reactants in chemical processes and as gas and in particular inert gas-generating substances. A problem is that with nitrogen-rich compounds the direct coupling with one another of N-atoms is not very stable and consequently such compounds are unusable for many purposes. Thus, although e.g. tetrazole is known as a very stable compound, it has a relatively low nitrogen content. The latter can be significantly increased in that two tetrazole rings are linked by an azo-bridge to 5,5'-azotetrazole. However, this compound is not very stable as a free acid.

5,5'-azotetrazole salts have also already been proposed as inert gas-generating substances. Thus, bis-(triaminoguanidinium)-5,5'-azotetrazolate is known for use in fire extinguishing agents (U.S. Pat. No. 4,601,344). However, this compound has such a high impact and friction sensitivity, that it is placed in the category of initiating explosives. The thermal stability is also so low that the compound has only a short life at elevated temperatures. The further known aminoguanidinium-5,5'-azotetrazolate has the same disadvantage (DE-B-2 004 620 with DE-A-34 22 433).

With diguanidinium-5,5'-azotetrazolate the invention proposes a compound which, as is apparent from its empirical formula $C_4H_{12}N_{16}$, has a high nitrogen content, namely 78.7% for a molecular weight of 284.5. Therefore as a salt of 5,5'-azotetrazole it is very stable and is substantially insoluble at room temperature in conventional organic solvents with the exception of methanol, dimethyl formamide and dimethyl sulphoxide. The solubility in water is also only very moderate. The thermal stability results from the established, relatively high melting point of 238° to 239° C. There is a virtually negligible weight loss of only 1% after storing for 50 days at 130° C. The advantage of the compound, particularly for technical uses is that the gases evolved on decomposition are harmless to humans, so that it can be used in close proximity to humans and in particular in closed rooms.

Appropriately commercial substances are used in the preparation of diguanidinium-5,5'-azotetrazolate. Thus, according to the invention, it is proposed that 5-aminotetrazole is converted into sodium-5,5'-azotetrazolate pentahydrate by oxidation and is reacted in aqueous solution with guanidinium chloride or nitrate to diguanidinium-5,5'-azotetrazolate.

Both aminotetrazole and guanidinium chloride or nitrate are commercially available, so that the substance according to the invention can be inexpensively produced.

The intermediate sodium-5,5'-azotetrazolate pentahydrate can be prepared in that 5-aminotetrazole monohydrate is dissolved in NaOH, pulverulent $KMnO_4$ is added to the solution, the reaction mixture is filtered off and sodium-5,5'-azotetrazolate pentahydrate is crystallized from the filtrate. The pentahydrate is subsequently reacted in aqueous solution with guanidinium chloride or nitrate to diguanidinium-5,5'-azotetrazolate. During this reaction the diguanidinium-5,5'-azotetrazolate is obtained as an easily filtrable, yellow precipitate and with a good yield.

EXAMPLE 50 g of 5-aminotetrazole monohydrate are dissolved, accompanied by stirring and at boiling temperature in 500 ml of 15% caustic soda solution. Over a period of roughly half an hour 65 g of potassium permanganate pulverized in the mortar are introduced. Excess $KMnO_4$ is e.g. reduced with ethanol. After a subsequent reaction lasting one hour the hot boiling, dark brown reaction mixture is filtered off over a heated filter funnel. The yellow sodium 5,5'-azotetrazolate pentahydrate crystallizes out in the filtrate. After recrystallizing and drying for 48 hours over phosphorus pentoxide 37.5 g are obtained (51.2% of the theoretical value). After concentrating the mother liquor and thorough washing of the manganese dioxide the yield can be raised to 75%.

12.0 g of the thus obtained sodium-5,5'-azotetrazole pentahydrate (0.04 mole) are dissolved in 100 ml of water at 50° C. and, accompanied by vigorous stirring, fed into a solution of 9.76 g of guanidinium nitrate (0.08 mole). A thick yellow precipitate forms which, after filtration, recrystallizing once from water at 100° C. and drying for 48 hours over $P_2O_5$ in a vacuum drying oven gives a yield of 9.5 g of diguanidinium-5,5'-azotetrazolate (84.1% of theory).

Analysis calculated for $C_4H_{12}N_{16}$: 16.9% C; 4.26% H; 78.8% N. Analysis found: 16.8% C; 4.13% H; 78.2% N.

The extremely good thermal stability of diguanidinium-5,5'-azotetrazolate (GZT) compared with the known bis-(triaminoguanidinium)-5,5'-azotetrazolate (TAGZT) or the also known aminoguanidinium-5,5'-azotetrazolate (AGZT) is apparent from the following Table I, which shows the weight loss as a percentage of a weighed portion of 1000 mg, at a constant temperature of 130° C. in each case two test series, for each of the three substances.

An important part is played in many branches of technology by the production of large gas quantities from solids with a relatively small volume. Reference is e.g. made to safety retention systems in motor vehicles (air bags), which initially have a small volume not impairing the comfort of the persons travelling in or the external appearance of the vehicle, but which in the case of an impact spontaneously produce large gas quantities, so as to protect and support the travellers with respect to hazardous parts of the vehicle. Further uses of such pyrotechnic means are inflatable rescue systems, such as dinghies, rafts and rescue ladders. They can also be used for accelerating projectiles, for the rapid transportation of electrolytic liquids from storage containers into accumulators for the activation thereof and for improving rocket solid fuels or tubular weapon powders.

The pyrotechnic means used up to now for inflating air cushions for persons travelling in motor vehicles, also known as air bags (DE-A-22 36 175), contain highly toxic sodium azide. This leads to considerable environmental problems in view of the constant increase in the number of vehicles carrying such air bags. Due to the water solubility of sodium azide in scrap yards, there is a risk of soil and ground water contamination. Under the action of acids, e.g. battery acid, the highly explosive hydrazoic acid is formed. Highly explosive heavy metal azides can form on contact with heavy metals such as lead, copper and brass.

Therefore efforts are being made to at least reduce the high percent by weight of sodium azide in such gas-generating mixtures, even if it does not prove possible to completely obviate the use of sodium azide (DE-A-3 733 176 and JP-A-02 184 590).

The compound according to the invention is eminently suitable to serve as a basic for a pyrotechnic mixture for generating environmentally friendly, non-toxic gases and which, despite the necessary high activity, also has high stability and long life under extreme conditions of use, in that diguanidinium-5,5'-azotetrazolate (GZT) is mixed with a pulverulent, chemically stable oxidizer.

The inventively used GZT can be processed as a pulverulent substance. In conjunction with a pulverulent, chemically stable oxidizer, which in particular must not be hygroscopic, it is possible to produce a mixture in which the oxygen balance is largely compensated. These mixtures are thermally very stable and insensitive to friction and impact. Thus, the invention proposes an azide-free, particularly sodium azide-free product, which is therefore much more friendly to the environment.

Preferably $KNO_3$ is used as the oxidizer. A mixture prepared therefrom with GZT can be finely ground in large charges as a result of its high handling safety, also due to the further characteristic values given hereinafter. Thus, it is in particular possible to produce a particle size spectrum, in which over 50% of the particles in the mixture have a diameter of $<15$ μm. The particle size distribution and particle size have a decisive influence on the activity of such a gas generating mixture, it naturally being necessary to ensure a homogeneous mixture.

By adding organic or inorganic binders, it is also possible to produce shaped articles or blanks from the powder mixture, whereby the binder proportion should not exceed 5% by weight. The burn-off behavior can be significantly influenced by the different blank geometry.

Information concerning the burn-off behavior and gas generation can be obtained by means of the pressure evolution (pressure-time curves) in the case of detonation tests in a ballistic bomb. The attached graph shows the pressure-time behavior of a GZT-$KNO_3$ formulation without binder in the case of a loading density of 10 g on 100 $cm^3$. 0.7 g of a priming mixture of boron and $KNO_3$ was used for priming purposes. For example the detonation delay, the slope steepness and the time until the maximum pressure is reached can be decisive for a particular use. The 30/80 time, i.e. the gradient of the burn-off curve between 30 and 80% of the maximum pressure is an important indicator of the activity of gas generation. The curve configuration in the pressure-time diagram or graph in the case of blanks can inter alia be influenced by their geometry. Any organic or inorganic binders present also influence the slope steepness.

Another possibility of controlling gas generation or the generation rate is the use of catalytic burn-off regulators, which can be used in a proportion of 0.1 to 5% by weight.

Particular reference is made as burn-off regulators to oxides of heavy metals of auxiliary groups of the periodic system of elements, particularly auxiliary groups I or VIII and more especially iron oxides. Organic or inorganic salts of these metals can also be used as burn-off regulators.

For a GZT-$KNO_3$ formulation without binders it was possible to establish the following characteristics. Information on the thermal stability can be obtained by measuring the weight loss at 130° C. in loosely closed testing tubes. It is only 0.3% by weight after 34 days in the case of a GZT-$KNO_3$ formulation. The explosion temperature of this formulation is between 251° and 253° C. in the case of a weighed portion of 0.2 g and a heating rate of 20K/min.

The impact sensitivity, determined according to the BAM falling weight method (Koenen und Ide "Explosivstoffe" 9 (1961) page 4, 30), is over 10 kpm, i.e. no reaction was observed with the 10 kp falling weight with a 1 m height of fall. There was also no reaction in the case of a pin load of 36 kp when determining the friction sensitivity (loc cit).

The following Table II gives the impact and friction sensitivity of GZT/$KNO_3$ on the one hand, pure GZT and the known TAGZT and AGZT on the other.

TABLE I

Weighed portion: 1000 mg Temperature: 130° C.

| Storage (days) | Weight loss (%) TAGZT 1 | TAGZT 2 | AGZT 1 | AGZT 2 | GZT 1 | GZT 2 |
|---|---|---|---|---|---|---|
| 1 | 9.60 | 9.40 | 5.20 | 5.10 | 0.30 | 0.40 |
| 2 | 40.1 | 40.2 | 5.20 | 5.20 | 0.30 | 0.40 |
| 3 | 41.7 | 41.9 | 5.40 | 5.30 | 0.40 | 0.50 |
| 4 | 42.7 | 42.9 | 5.40 | 5.30 | 0.40 | 0.50 |
| 7 | 44.3 | 44.6 | 5.60 | 5.50 | 0.40 | 0.60 |
| 8 | 44.5 | 44.9 | 5.60 | 5.50 | 0.40 | 0.60 |
| 9 | 44.8 | 45.2 | 5.60 | 5.50 | 0.40 | 0.60 |
| 14 | 46.3 | 46.9 | 6.10 | 6.00 | 0.40 | 0.60 |
| 15 | 46.3 | 46.9 | 6.10 | 6.00 | 0.40 | 0.60 |
| 16 | | | 6.40 | 6.40 | 0.70 | 0.80 |
| 17 | | | 6.20 | 6.20 | 0.40 | 0.60 |
| 18 | | | 6.40 | 6.40 | 0.50 | 0.60 |
| 22 | | | 7.00 | 7.10 | 0.50 | 0.60 |
| 23 | | | 7.40 | 7.50 | 0.50 | 0.60 |
| 24 | | | 7.60 | 7.70 | 0.50 | 0.60 |
| 25 | | | 7.80 | 8.00 | 0.50 | 0.60 |
| 28 | | | 9.30 | 10.20 | 0.60 | 0.70 |
| 29 | | | 10.00 | 11.10 | 0.60 | 0.70 |
| 30 | | | 10.80 | 12.30 | 0.60 | 0.70 |
| 35 | | | 18.80 | 23.60 | 0.70 | 0.80 |
| 36 | | | | | 0.70 | 0.80 |
| 37 | | | | | 0.70 | 0.80 |
| 38 | | | | | 0.70 | 0.80 |
| 39 | | | | | 0.70 | 0.80 |
| 42 | | | | | 0.80 | 0.90 |
| 43 | | | | | 0.80 | 0.90 |
| 44 | | | | | 0.80 | 0.90 |
| 45 | | | | | 1.00 | 1.10 |
| 49 | | | | | 1.00 | 1.10 |

TABLE II

| | Impact Sensitivity (kpm) | Friction Sensitivity (kp) |
|---|---|---|
| TAGZT | 0.15–0.16 | 10.8 |
| AGZT | 0.7 | 36.0 |
| GZT | 0.75 | 36.0 |
| GZT/$KNO_3$ | none | none |

We claim:

1. A pyrotechnic mixture for generating environmentally friendly, non-toxic gases, comprising diguanidinium-5,5'-azotetrazolate (GZT) mixed with a pulverulent, chemically stable oxidizer.

2. A pyrotechnic mixture according to claim 1, wherein the oxidizer is $KNO_3$.

3. A pyrotechnic mixture according to claim 1 or 2, wherein the mixture is finely ground.

4. A pyrotechnic mixture according to claim 3, wherein more than 50% of the particles in the mixture have a particle diameter smaller than 15 μm.

5. A pyrotechnic mixture according to claim 1 or 2, wherein the mixture is compacted to blanks.

6. A pyrotechnic mixture according to claim 5, wherein organic or inorganic binders are added in a proportion up to 5% by weight for forming the blanks.

7. A pyrotechnic mixture according to claim 1, further comprising a catalytic burn-off regulator for controlling gas generation in a proportion of 0.1 to 5% by weight.

8. A pyrotechnic mixture according to claim 7, wherein the burn-off regulator is an oxide of heavy metals of auxiliary groups of the periodic system.

9. A pyrotechnic mixture according to claim 8, wherein the burn-off regulator is an oxide of heavy metals of auxiliary groups I or VIII of the periodic system of elements.

10. A pyrotechnic mixture according to claim 8 or 9, wherein the burn-off regulator is an iron oxide.

11. A pyrotechnic mixture according to claim 6, wherein the burn-off regulator at least one of organic or inorganic salts of heavy metals of auxiliary groups of the periodic system.

12. A pyrotechnic mixture according to claim 3, wherein the mixture is compacted to blanks.

13. A pyrotechnic mixture according to claim 4, wherein the mixture is compacted to blanks.

14. A method for generating environmentally friendly, non-toxic gases comprising reacting a pyrotechnic mixture comprising diguanidinium-5,5'-azotetrazolate (GZT) and a pulverulent, chemically stable oxidizer.

* * * * *